US006123445A

United States Patent [19]

Grassi

[11] Patent Number: 6,123,445

[45] Date of Patent: Sep. 26, 2000

[54] DUAL STAGE CONTINUOUS MIXING APPARATUS

[76] Inventor: Frank Grassi, 1793 Manchester Blvd., Grosse Pointe Woods, Mich. 48236

[21] Appl. No.: 09/213,000

[22] Filed: Sep. 12, 1997

Related U.S. Application Data

[60] Provisional application No. 60/026,166, Sep. 16, 1996.

[51] Int. Cl.[7] ..... B28C 5/14

[52] U.S. Cl. ..... 366/20; 366/21; 366/28; 366/35; 366/50; 366/66; 366/157.2; 366/171.1; 366/302; 366/320

[58] Field of Search ..... 366/337, 28, 14, 366/15, 20, 21, 27, 30, 35, 38, 40, 50, 52, 64, 66, 67, 156.1, 156.2, 157.1, 157.2, 158.4, 158.5, 168.1, 171.1, 172.2, 172.1, 174.1, 175.2, 181.5, 186, 193, 194–196, 302, 307, 310, 320

[56] References Cited

U.S. PATENT DOCUMENTS

| | | | |
|---|---|---|---|
| 821,790 | 5/1906 | Dorweiler . | |
| 2,276,237 | 3/1942 | Lowry . | |
| 2,785,455 | 3/1957 | McElroy . | |
| 3,536,300 | 10/1970 | Ainsworth et al. . | |
| 3,711,067 | 1/1973 | Kovacs . | |
| 3,827,676 | 8/1974 | Brasie | 366/337 |
| 4,117,547 | 9/1978 | Mathis et al. | 366/50 |
| 4,175,867 | 11/1979 | Piazza | 366/337 |
| 4,372,734 | 2/1983 | Dolan et al. . | |
| 4,449,826 | 5/1984 | Mathis et al. | 366/15 |
| 4,478,516 | 10/1984 | Kessler . | |
| 4,778,276 | 10/1988 | Meyer et al. | 366/64 |
| 4,801,210 | 1/1989 | Gian | 366/156.1 |
| 4,944,347 | 7/1990 | Richard et al. . | |
| 5,213,414 | 5/1993 | Richard et al. | 366/35 |
| 5,352,035 | 10/1994 | Macaulay et al | 366/38 |
| 5,570,953 | 11/1996 | DeWall | 366/157.1 |
| 5,609,416 | 3/1997 | Duckworth | 366/38 |
| 5,718,508 | 2/1998 | Williams | 366/50 |
| 5,785,420 | 7/1998 | Schuff | 366/35 |
| 5,810,470 | 9/1998 | Garrant et al. | 366/50 |

*Primary Examiner*—Charles E. Cooley
*Attorney, Agent, or Firm*—Emrich & Dithmar

[57] ABSTRACT

A mixer for dry powder, very fine or granular materials and a liquid, e.g., mortar or cement and water, includes a dynamic input mixing stage, a static output mixing stage and a transition tube connecting the two stages in a manner which isolates the two stages from one another. The input mixing stage includes a hopper for receiving the mortar and a horizontal metering screw having a detachable mixing auger. The auger mixes the dry mortar, while the metering screw moves the mixed mortar through a discharge aperture in the hopper and into the transition tube. The metering screw extends into the transition tube for further displacing the dry mortar into the output mixing stage which includes a mixing tube having a fixed internal baffle assembly and an auger disposed along its length. A source of water is connected to the mixing tube for forming a mortar-water slurry. The auger is detachably connected to the metering screw for rotation therewith and acts as a pumping mechanism for discharging the slurry and preventing water from entering the transition tube. The baffle assembly includes an elongated axial rod removably inserted within the auger in the mixing tube and having a plurality of spaced baffles of alternating alignment disposed along its length for statically mixing the slurry. A pair of pivoting closure plates are disposed adjacent the aperture in the hopper for adjusting or shutting off the flow of mortar from the hopper to the transition tube.

40 Claims, 3 Drawing Sheets

DUAL STAGE CONTINUOUS MIXING APPARATUS

RELATED APPLICATION

This application claims the benefit of copending U.S. Provisional Application No. 60/026,166, filed Sep. 16, 1996.

FIELD OF THE INVENTION

This invention relates to a mixer for dry powder or granular materials and liquid materials, e.g. mortar and water.

PRIOR ART DEVELOPMENTS

It is known that mortar and water can be mixed together by means of a screw-type mixer. One such apparatus, marketed under the designation WAM CMM, comprises three stages. In a first stage a dry mortar-sand mix is taken from an overhead hopper and homogenized in a dry mixing area by means of a horizontal mixing screw. A second stage comprises a second chamber for remixing partially mixed materials. In a third stage water is added to the mixed materials to produce a mortar-water mixture suitable for use in masonry applications. The third stage includes a paddle-screw system designed to intimately mix the mortar and water without clogging. The mixing components are disconnectable from the mixer housing to facilitate cleanup of the mixing element surfaces.

SUMMARY OF THE PRESENT INVENTION

The present invention relates to a mixer, especially a mixer adapted to mix water with mortar or cement in granular (powder) form, to produce a viscous solid-liquid suspension suitable for use in the masonry field. Other liquid components can be added such as color and foam.

In a preferred form of the invention, the mixing apparatus comprises a hopper for granular material, e.g. cement or mortar. A horizontal metering screw-extends transversely through the hopper into a mixing tube that conveys the granular material away from the hopper. A mixing auger is detachably connected to the metering screw for moving the granular material along the mixing tube, Water is injected into the mixing tube near the tube inlet opening, so that the granular particles are intermixed with water as the materials move along the tube.

A baffle mechanism is provided in the mixing tube, to cause the solid-liquid particles to periodically angle in different directions as it travels through the tube. This back-and-forth motion of the solid-liquid particles promotes the mixing process, whereby the slurry discharged from the tube is relatively homogeneous.

An advantageous feature of the invention is a clamshell type closure on the hopper, where the dry granular material moves from the hopper into the mixing tube. The closure can be manipulated to close the space surrounding the shaft of the metering screw, thereby preventing the flow of dry granular material from the hopper into the mixing tube. The closure is designed so that it can be moved to the closed position while the metering screw continues to drive the mixing auger, such that the auger can transport a residual quantity of viscous solid-liquid material out of the tube.

To effect a shutdown of the mixing apparatus, the clamshell closure is closed around the metering screw shaft while the metering screw continues to run. The auger transports viscous product out of the mixing tube to prevent the product from hardening in the tube while the apparatus is inactive.

Preferably the mixing tube is detachably connected to the hopper, so that the tube interior can be accessed and cleaned. Also, the auger and baffle mechanism are floatably positioned in the tube, such that the auger and baffle mechanism can be individually removed from the tube for cleaning purposes. All work surfaces in contact with the solid-water mixture are accessible for easy cleaning of the mixing tube.

The apparatus is relatively easy to operate. Control of the mixing process involves operational control of the power source for the metering screw and auger, and operational control of the water injection mechanism.

A principal advantage of the mixing apparatus is that it can be relatively fast and efficient. In one particular apparatus embodying the invention, a one man operation can mix up to about three bags of premix mortar per minute, to produce about 3.5 yards of product per hour.

Another advantage of the apparatus is that it is space efficient. The mixer is compact and not excessively heavy. It can be used on morgan-type scaffolds or indoors, if necessary.

A further advantage of the invention is that the mixing tube, auger and baffle mechanism are removable from the hopper to facilitate clean-up. Also, as noted earlier, the clamshell closure in the hopper permits viscous product in the mixing tube to be pumped out of the tube without feeding dry material into the tube. This feature greatly reduces the quantity of material in the tube that has to be removed by the clean-up operation.

The mixing apparatus of this invention has relatively few moving parts. Minimal maintenance is required to keep the apparatus operational. Further features and advantages of the invention will be apparent from the attached drawings and description of a preferred embodiment of the invention.

THE DRAWINGS

DESCRIPTION OF THE PREFERRED EMBODIMENT OF THE INVENTION

The drawings show a mixing apparatus for mortar and water, wherein the mortar is pre-blended with sand or other fillers. The mixing operation produces a semi-liquid slurry that can be used for masonry purposes, e.g. building walls, laying floors, etc.

Figure 1:
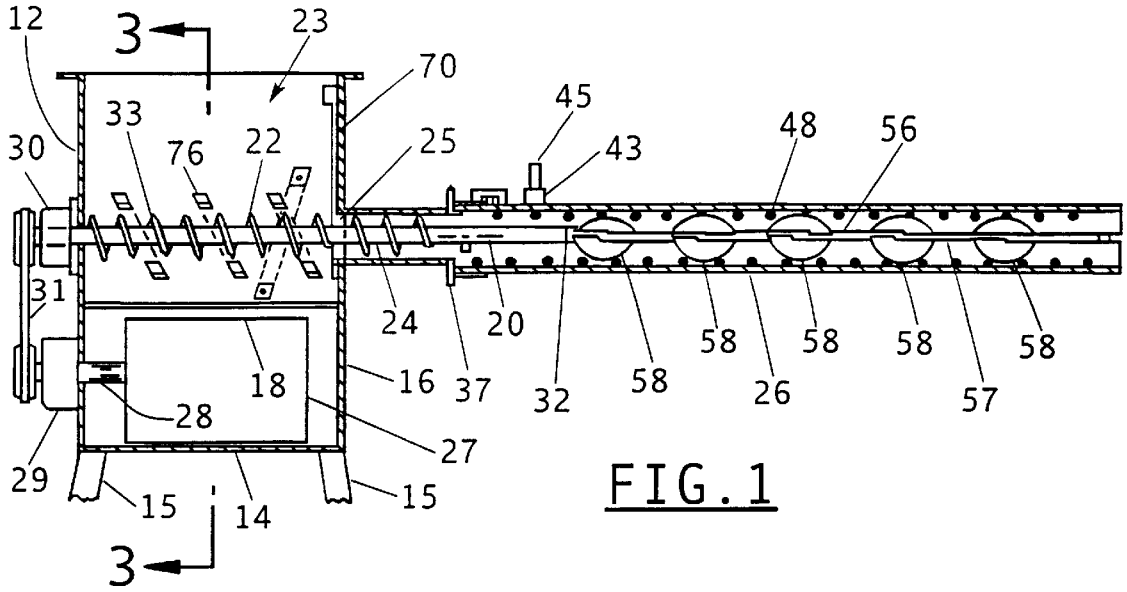
FIG. 1 is a sectional view taken through an apparatus embodying the invention.
Figure 2:
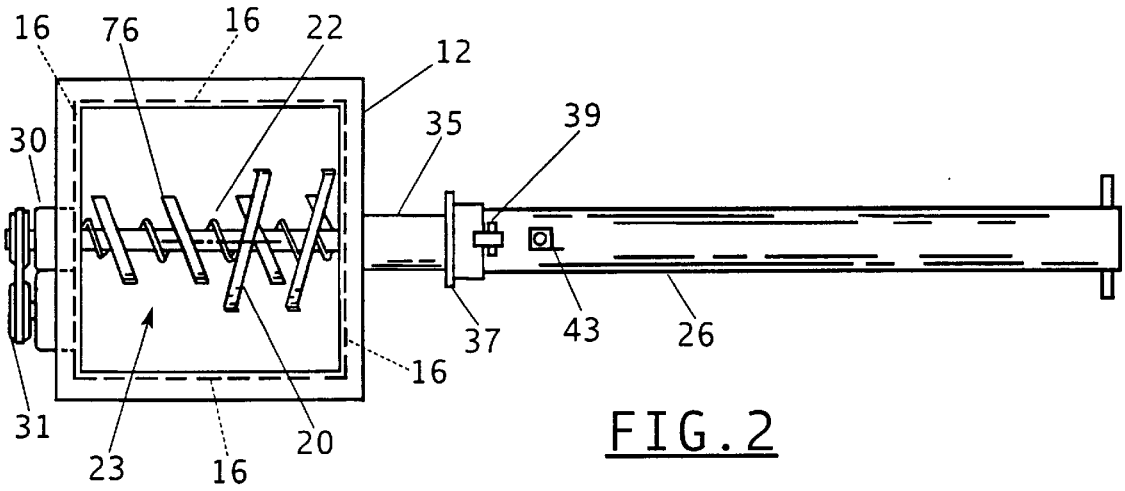
FIG. 2 is a top plan view of the FIG. 1 apparatus.
Figure 3:
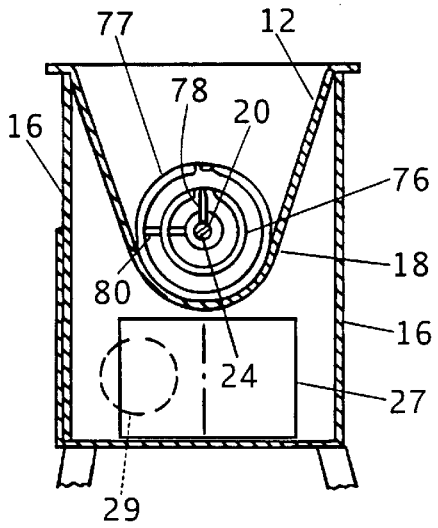
FIG. 3 is a transverse sectional view taken on line 3—3 in FIG. 1.

The apparatus shown in FIGS. 1 through 3, comprises a hopper 12 that includes an upright cabinet having a bottom wall 14 and four upright side wails 16. The cabinet can be supported by four legs 15. As shown in FIG. 3, the cabinet has an interior trough-forming wall 18 that includes an arcuate lower wail portion centered on an imaginary axis 20. Dry granular material, e.g. preblended mortar or cement, is poured into the hopper through the hopper mouth opening, as indicated by arrow 23 in FIG. 1.

A horizontal metering screw 22 is located-in hopper 12 for rotation around axis 20, whereby the screw moves the dry granular material through an opening 25 in one wall of the hopper into a mixing tube 26. Screw 22 can be powered in various different ways, e.g. a gasoline engine, an electric motor, or a hydraulic motor.

As shown in FIG. 1, a gasoline engine 27 is mounted on the bottom wall 14 of the cabinet to drive a shaft 28 and clutch 29. The clutch preferably is disengageable or adjustable to permit the metering screw to slow or stop moving while the engine continues to run. Clutch 29 delivers power to the metering screw 22 by means of a belt-pulley drive transmission 31. The metering screw is supported for rotational movement by a sealed heavy duty bearing means 30 affixed to the left wail of the cabinet.

Metering screw 22 extends through hopper 12 and into the mixing tube 26, so that the right end of the metering screw shaft 24 is within tube 26. As shown in FIG. 1, the shaft of the metering screw has a screw-forming flight 33 extending from the left wail of the hopper to a point beyond the hopper right wall. The right end portion of the shaft is bare i.e. devoid of screw material.

The metering screw can have various dimensions. However, in one particular case the screw has a shaft diameter of about 1½", a screw outside diameter of about 4" and screw pitch distance of about 3".

Metering screw 22 extends into a circular transition tube 35 that is welded, or otherwise secured, to the right wall of hopper 12. The screw has a close clearance with respect to the tube 35 inner diameter, such that the screw is enabled to move granular material through tube 35 into the mixing tube 26. The purpose of the transition tube 35 is to provide a separation zone between the dry granular material in hopper 12 and the wet slurry produced in mixing tube 26 and to direct the fluidized dry granular material over the static baffles.

Figure 6:
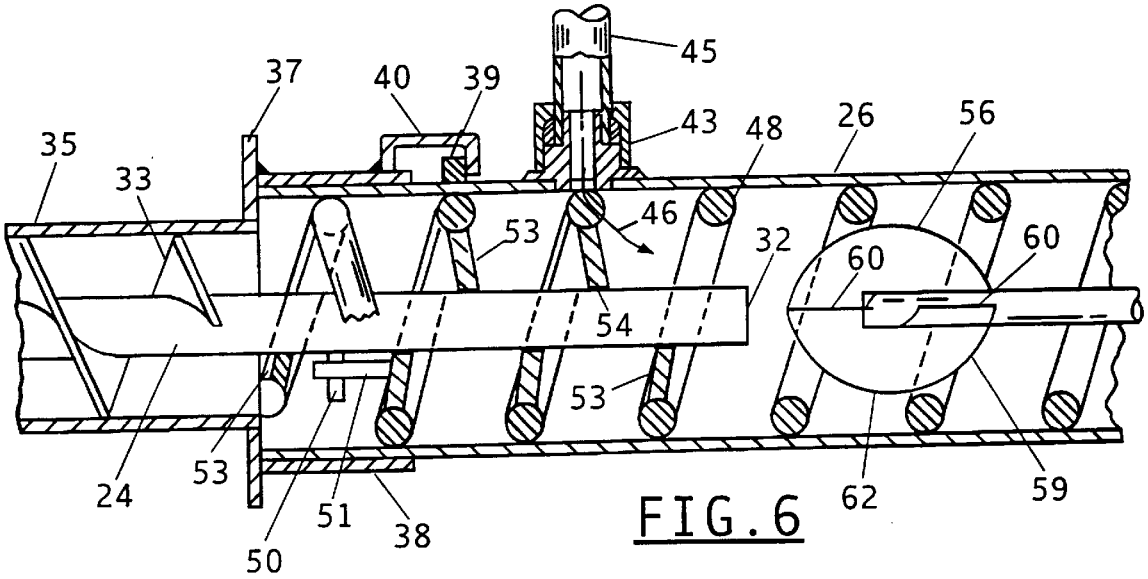
FIG. 6 is an enlarged fragmentary sectional view showing structural connections at the supply hopper and mixing tube in the FIG. 1 apparatus.
Figure 7:
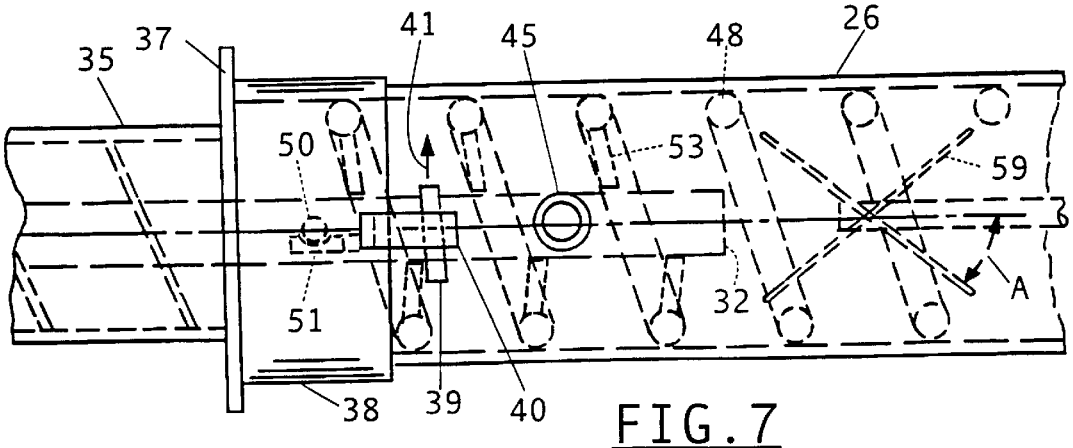
FIG. 7 is a top plan view of the structure depicted in FIG. 6.

As shown in FIGS. 6 and 7, mixing tube 26 is detachably joined to the transition tube 35 for clean-up purposes. Various mechanisms can be used to detachably connect the mixing tube 26 to the transition tube, e.g. a threaded connection, or a flange bolt on connection. The drawings show a cam lug type connection.

Transition tube 35 has a flange 37 at its discharge end for mounting a collar 38. The mixing tube 26 has a removable telescopic fit in the collar, such that the mixing tube is supported in cantilever fashion by tube 26. A lug 39 on the exterior surface of tube 26 is adapted to move into the space below a channel-shaped bracket 40 extending from collar 38, when tube 26 is rotated as indicated by arrow 41 in FIG. 7.

As shown in FIG. 7, the right edge surface of lug 39 is angled at about 5° degrees to the rotational plane of lug motion, so that when tube 26 is rotated in the arrow 41 direction the lug has a cam action on bracket 40, urging tube 26 axially against the face of flange 37. When tube 26 is rotated in the reverse direction (opposite to arrow 41) the lug 39 is separated from channel 40. FIGS. 6 and 7 show the lug-channel relationship that occurs when the mixing tube is operably connected to the transition tube 35; i.e. when the apparatus is used to produce a useful aggregate water product.

Mixing tube 26 is equipped with a water fitting 43 that mounts a water supply hose 45. Pressurized water flows from hose 45 into the mixing tube, as indicated by arrow 46 in FIG. 6, such that the water is mixed with the granular material being transported through tube 26. Water flow through tube 26 can be controlled by a conventional volumetric flow control means, so that the water flow rate into tube 26 is relatively constant in spite of any pressure variations that might occur in the water supply. Also, an on-off valve is preferably provided to achieve a desired shut-off of the water flow, e.g. when it is desired to deactivate the apparatus.

The mixing tube has a larger diameter than the transition tube to promote a satisfactory mixing action.

A screw-type auger 48 is provided in tube 26 for mixing the water with the granular material, and for transporting the mixture along the tube in a left-to-right direction. Auger 48 is shown as an elongated cylindrical rod formed into a coil configuration so that the outer surface of each coil convolution has a sliding fit on the inner surface of tube 26. The tube supports the auger weight.

Typically, the rod stock for auger 48 has a diameter of about ⅝". The rod coiled configuration has an outside diameter of about 4¾", and an axial length of about 4 ft. The coil extends axially substantially the entire length of mixing tube 26. The auger coil pitch distance is about 3".

Auger 48 is powered by metering screw 22. while at the same time being detachable from the metering screw for clean-up purposes.

Various mechanisms can be used to detachably connect auger 48 to the shaft of metering screw 22. As shown in FIGS. 6 and 7, the detachable connection comprises a pin 50 extending from shaft 24 of the metering screw to intersect an axially-extending arm 51 carried by auger 48.

As the metering screw 22 turns on the shaft 24 axis, pin 50 strikes one face of arm 51, whereby rotational power is transferred from shaft 24 to the auger. Pin 50 remains in contact with arm 51 during the mixing operation. Arm 51 preferably has a concave surface that tends to prevent axial separation of the auger from the metering screw.

Auger 48 has a helical wall 53 extending from the rod coil inner surface toward shaft 24. Helical wail 53 has an arcuate inner edge 54 that has a close clearance relative to shaft 24, whereby wall 53 is effective for moving the mix in a left-to-right direction within tube 26.

Helical wall 53 is continuous from the left end of the auger coil to about the third coil convolution; i.e. Wall 53 extends for about three complete convolutions of the auger coil. The coil is bare for the remainder of its length. The left end of helical wail 53 is relatively close to the terminal end of the metering screw flight 33 such that the auger picks up the dry granular material without creating any voids or discontinuities in the flow. The pitch of the auger screw 48 may be slightly less than the pitch of metering screw.

There is provided in mixing tube 26 a baffle mechanism 56, that comprises an axial rod 57 and five sets of baffles 58. FIG. 1 shows the baffles spaced along the length of rod 57. Each set of baffles comprises flat baffle plates 59 acutely angled to rod 57 at an angle A of about 40°. Each baffle plate has a flat inner edge 60 extending through the axis of rod 57, and an arcuate outer edge 62 adapted to slidably rest on an inner edge surface of the auger 48 coil. Thus, the baffle mechanism is supported (partially) by auger 48, and auger 48 is supported by mixing tube 26. This arrangement facilitates removal of the baffle mechanism and the auger from tube 26 for clean-up purposes.

Figure 9:
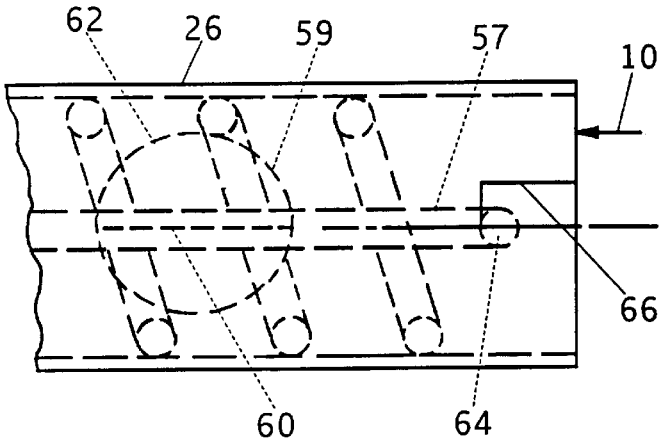
FIG. 9 is a top plan view of the FIG. 8 mechanism.

The right end of rod 57 is attached to a cross piece 64 that is adapted to fit into two opposed slots 66 formed in the discharge end of mixing tube 26. As shown in FIG. 9, each slot 66 has a bayonet configuration, whereby the cross piece 64 can fit into the bayonet notches to prevent the baffle mechanism 56 from shifting axially within tube 26. However, when necessary, the baffle mechanism can be removed from tube 26 by lifting the cross piece 64 upward out of the notches, and pulling the cross piece rightwardly out of the slots 66. Cross piece 64 serves as a handle for pulling the baffle mechanism out of tube 26. Cross piece 64 also serves as a support device for the right end of the baffle mechanism. Slots 66 are oriented so that when cross piece 64 is seated in the notches formed by the slots (as per FIG. 9) the baffle support rod 57 is located on the tube 26 axis.

The baffle mechanism is jointly supported by bayonet slots 66 and the auger coil 48, i.e. the sliding support of the coil convolutions on the outer edges of baffle plates 59. The baffle mechanism is non-rotatable, whereas the auger coil 48 is rotatable via drive connection 50, 51.

Figure 8:
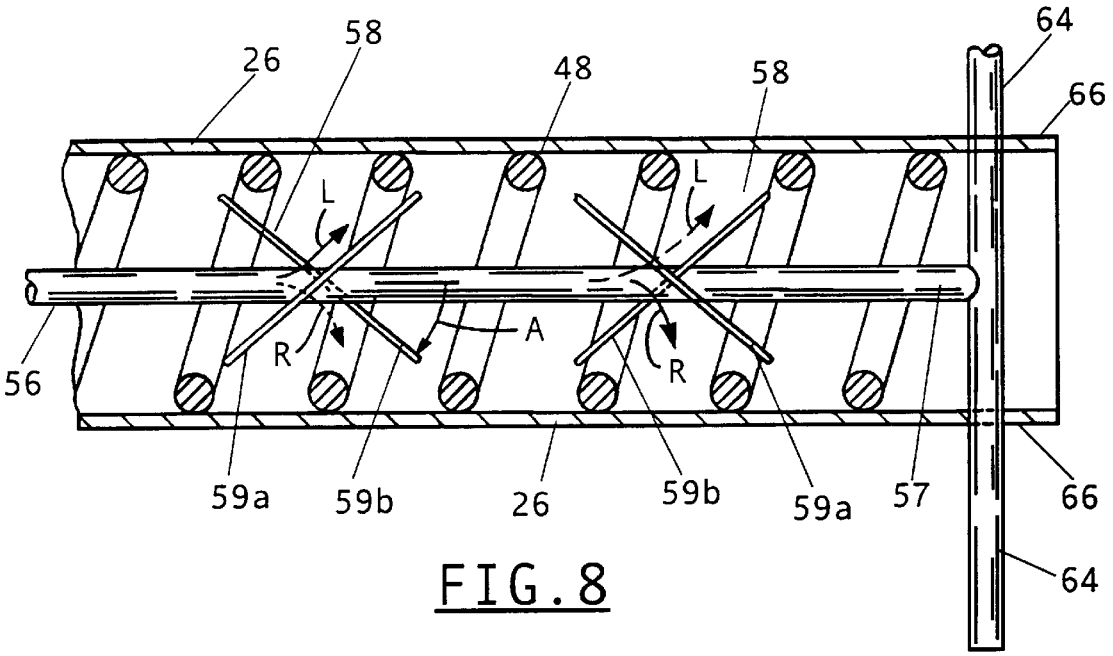
FIG. 8 is a fragmentary enlarged sectional view of the mixing tube and auger used in the FIG. 1 apparatus, taken at the discharge end of the tube.

Each set of baffle plates 58 includes an upper baffle plate and a lower baffle plate. these baffle plates are angled so that the baffling action is in a different direction in successive sets of plates. Referring to FIG. 8, the downstream set of baffle plates comprises an upper plate 59 angled to divert the oncoming flow to the right, as indicated by arrow R, and a lower plate 59*b* angled to divert the oncoming flow to the left, as indicated by arrow L. In contrast, the upstrearm set of baffle plates comprises an upper plate 59*a* angled to divert the oncoming flow to the left (as indicated by arrow L) and a lower plate 59*b* angled to divert the oncoming flow to the right, as indicated by arrow R.

In the illustrated apparatus, there are five sets of baffle plates. In the first, third and fifth sets the upper baffle plate diverts the flow to the right; and in the second and fourth sets the upper baffle plate diverts the flow to the left course, in each case the lower plate diverts the flow in the opposite direction; i.e. to the left in the first, third and fifth sets; and to the right in the second and fourth sets.

As a variant of the invention, the baffle plates can be oriented to divert the flow in other directions e.g. up or down (rather than right or left). The principal objective is to move the solid and liquid particles back and forth angularly to the mixing tube axis, to achieve a homogeneous mixture at the discharge end of the tube. The baffle system promotes the mixing action, and incidentally reduces the required length of mixing tube 26. Typically, tube 26 can have a length of about 4 ft.

By way of summarizing the action taking place in the mixing apparatus, a continuous mixing operation is achieved by the conjoint action of metering screw 22, auger 48 and baffle mechanism 56. Metering screw 22 is powered by power source 27 to move dry granular material from hopper 12 into and through transition tube 35. Auger 48 is connected to screw 22, via pin 50 and arm 51, so that auger 48 transports the material through tube 26. Water is introduced to the mix by hose 45. Such that water and solid particles mix together in the zone to the right of water fitting 43.

The helical wall 53 on the auger acts as a pumping mechanism, and also as a barrier to water flow in a right-to-left direction. Water is confined to the area to the right of the water intake point. As the water-particulate mix moves through tube 26 the baffle plates 59 deflect the mix angularly in different directions, to improve and enhance the mixing action. The operation is continuous, as long as metering screw 22 is delivering granular material to tube 26, and hose 45 is delivering water to the granular material in tube 26.

The auger 48 rod coil is designed to slide along the inner surface of tube 26, to act as a scraper for granular material. Gravitational forces cause material near the roof area of tube 26 to collapse toward the tube 26 axis for mixing with the slurry that is formed by the injection of water into the tube. The apparatus has been found to provide a homogeneous mixture, having a relatively constant viscosity on a consistent long term basis. There is minimal need for changing or altering the water flow rate and metering screw speed in order to achieve a consistent product.

The apparatus can be periodically stopped and restarted (by stopping the water flow and metering screw) to keep product flow in pace with demand for the product at the discharge end of tube 26. When it becomes necessary to shut down the apparatus for a prolonged period. e.g. at the end of the work day, the apparatus has to be dismantled and cleaned.

Figure 4:
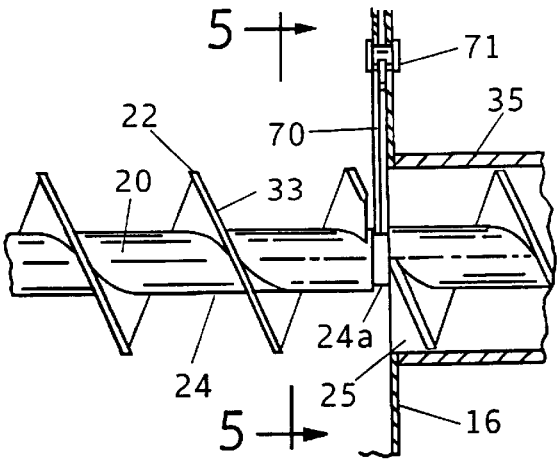
FIG. 4 is an enlarged sectional view of a structural detail used in the FIG. 1 apparatus.
Figure 5:
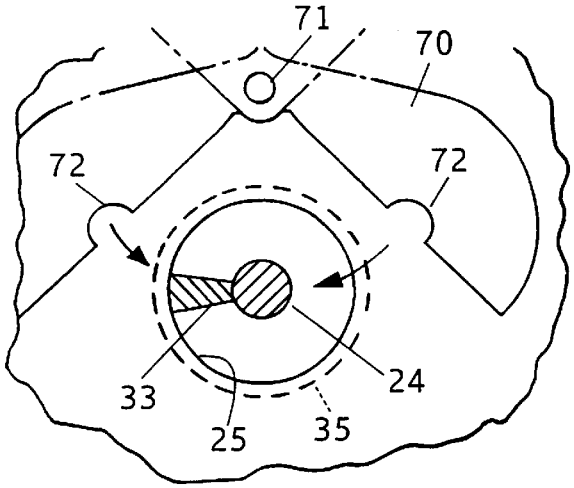
FIG. 5 is a transverse sectional view taken on line 5—5 in FIG. 4.

Prior to dismantling the apparatus, the metering screw should be run for a short time to remove product from tube 26 (to lessen the weight of tube 26 and minimize the quantity of material that has to be cleaned out of the tube). FIGS. 4 and 5 show a closure mechanism that can be operated to allow the metering screw 22 to clear the tube 26 of product mixture without feeding dry granular material into tube 26.

The closure mechanism of FIGS. 4 and 5 comprises two overlapped closure plates 70 pivotally mounted on a side wall of hopper 12 for swinging motion around a common pivot 71. Each closure plate has a concave inner edge 72 adapted to fit into a groove 24*a* in the metering screw shaft 24 when the closure plates are swung toward the shaft, as indicated by the arrows in FIG. 5. The closure plates can be manipulated by handles on the upper ends of the plates, i.e. near the mouth of hopper 12.

The plate edges 72 have a sliding fit on shaft 24 when the plates are in the closed position, whereby the metering screw can be powered by the power source 27 while the plates are closed on the metering screw shaft. The helical flight on the screw has a break slightly wider than the width dimension of closure plates 70, such that the screw does not obstruct the closure plate movement between the open and closed positions.

With plates 70 in the closed position the dry aggregate in hopper 12 cannot be moved into transition tube 35. However the metering screw can drive auger 48 to clear tube 26 of residual quantities of the product being produced. Essentially all of the product in tube 26 can be used. At the same time, tube 26 is effectively evacuated to a relatively clean condition.

Figure 10:
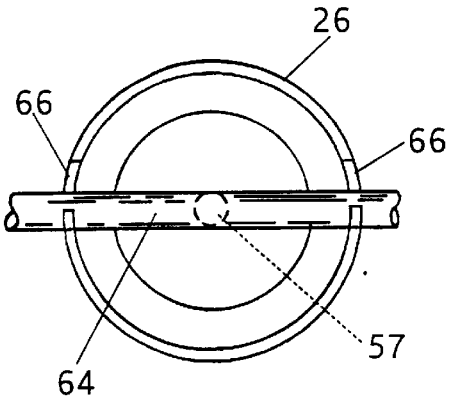
FIG. 10 is a right end view of the FIG. 9 mechanism, taken in the direction of arrow 10 in FIG. 9.

Closure plates 70 co not produce a microscopically clean tube 26. It is necessary to dismantle tube 26, auger 48 and baffle mechanism 56 so that each can be cleaned separately. Preferably the tube, auger and baffle mechanism are removed from transition tube 35 as a unit. This is accomplished by turning cross piece 64 in a counterclockwise direction, as viewed in FIG. 10. The handle 64 transfers a counterclockwise force to tube 26, whereby the tube can be rotated to withdraw lug 39 from bracket 40 (FIGS. 6 and 7). At the same time arm 51 disconnects from pin 50. The handle 64 can then be pulled axially to move tube 26 out of collar 38. Auger 48 and baffle mechanism 57 can be taken out of tube 26 after the tube has been detached from collar 38. With the tube, auger and baffle mechanism separated from each other, they can be cleaned individually.

The cleaned components can be reattached to hopper 12 by reversing the above sequence of movements. The process is readily accomplished.

FIGS. 1 through 3 show a mechanism for agitating the granular material in hopper 12 to improve the flow of such material within the hopper and through the exit opening 25. The mechanism comprises an inner helical agitator 76 and an outer helical agitator 77. Each agitator is connected to metering screw shaft 24 by two or more radial pins or struts. FIG. 3 shows a representative strut 78 for connecting agitator 76 to shaft 24, and a representative strut 80 for connecting agitator 77 to shaft 24.

Each agitator can De formed out of square cross sectioned bar stock formed into a helix having approximately three revolutions. The outer diameter of helical agitator 76 is approximately 6", i.e. materially greater than the diameter of the metering screw 22. The outer diameter of helical agitator 77 is approximately 10", such that the agitator outer edge is continually in close proximity to arcuate trough wall 18 as the metering screw rotates around shaft axis 20. Each helical agitator 76 or 77 is concentric around axis 20.

The function of agitator 76 is to promote a left-to-right flow of granular material in hopper 12 when the metering screw 22 is rotating. Agitator 76 has the same angular direction as screw 22. The metering screw continually moves granular material in a left-to-right direction, such that there is a tendency for material in the hopper proximate to exit opening 25 to be depleted to an undesired extent. Granular material surrounding the metering screw has to flow into the spaced formed by the flutes of the screw in order for the screw to deliver a relatively constant quantity of material into the transition tube 35. Agitator 76 produces a rightward flow of granular material toward the exit wall of the hopper that replenishes material taken by the screw out of the hopper. Agitator 76 achieves an anti-cavitation effect, to keep the 22 relatively full and effective for granule pumping purposes.

The function of agitator 77 is to promote a right-to-left flow of material in hopper 12, especially when closure plates 70 are in the closed positions. Agitator 77 has a helix direction that is opposite to the angular direction of the helical flutes of metering screw 22. Screw 22 tends to move granular material in a left-to-right direction, whereas agitator 77 tends to move granular material in a right-to-left direction.

When plates 70 are in the closed positions the metering screw 22 tends to produce a pressure pile up of granular material against the left faces of plates 70 (because the plates are in the normal path of the granular material). Agitator 77 relieves the pressure of the material against plates 70 by transporting some of the material away from plates 70, i.e. in a right-to-left direction.

As screw 22 forces granular material against plates 70 the impacted granules generate a radial pressure along the left surfaces of plates 70. Agitator 77 takes material away from plates 70 to at least partially relieve the impaction pressure. The effect of agitator 77 is to minimize such excessive packing of granular material proximate to plates 70, as might prevent the screw from moving the material when the closure plates re later opened. If the granular material is allowed to pack together into a solid mass, the metering screw will be unable to pump the material out of the hopper when closure plates 70 are opened. Agitator 77 prevents excessive packing of the granular material against closure plates 70.

By way of review, the apparatus comprises a metering screw 22 for delivery dry granular material from hopper 12 through transition tube 35 into the water mixing tube 26. The mixing tube is detachable from tube 35 for clean-up purposes.

Tube 26 contains a helical auger 48 that has a disconnectable drive connection 50, 51 with the shaft of metering screw 22, whereby the metering screw delivers a driving force to the auger. Water is delivered from a water supply hose 45 into tube 26 at a point spaced axially from transition tube 35. Auger 48 comprises a continuous helical wail 53 that spans the water entry point, such that water is fed into a relatively confined space defined by the convolutions of wall 53. The water thus has an initial concentrated contact with new granular material.

The solid-liquid mixture is transported along mixing tube 26 so as to be baffled angularly back and forth by the various baffle plates 59. The resultant product is thoroughly mixed, to provide a homogeneous character at the discharge end of tube 26.

At shutdown the closure plates 70 can be closed, after which the metering screw 22 can be run for a predetermined time period to remove product accumulations from tube 26 (while preventing dry material from moving from the hopper into transition tube 35). Tube 26, auger 48 and baffle mechanism 56 can be disconnected from the hopper to facilitate clean-up operations. During such operations the dry material in hopper 12 can remain in the hopper. It is not necessary to empty hopper 12 to clean the apparatus.

While particular embodiments of the present invention have been shown and described, it will be apparent to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A continuous mixing apparatus for particulate materials comprising:

a dynamic input mixing stage including a housing adapted to receive the particulate materials and first displacement means for moving the particulate materials toward and through an aperture in said housing;

a transition tube coupled to said housing adjacent the aperture therein for receiving the particulate materials upon discharge through the housing aperture by said first displacement means; and a static output mixing stage coupled to said transition tube for receiving the particulate materials from said transition tube, said output mixing stage including a mixing tube coupled to a source of liquid for adding a liquid to the particulate materials in forming a slurry, second displacement means disposed in said mixing tube for displacing the particulate material and slurry along said mixing tube and discharging the slurry from the mixing tube, and a baffle assembly fixedly disposed within and along the length of said mixing tube for thoroughly mixing the particulate materials and the liquid in forming the slurry prior to discharge from said mixing tube wherein said transition tube and said mixing tube are coaxially aligned.

2. The apparatus of claim 1 wherein an upper portion of said housing is open to facilitate receiving the particulate materials and wherein said first displacement means includes a metering screw.

3. The apparatus of claim 2 wherein said metering screw extends through the aperture in said housing and into said transition tube for further moving the particulate materials to said output mixing stage.

4. The apparatus of claim 3 further comprising adjustable closure means disposed adjacent the aperture in said housing and in closely spaced relation about said metering screw for adjusting or terminating the flow of particulate material from said housing to said transition tube.

5. The apparatus of claim 4 wherein said closure means includes at least one plate movable between a first closed position over the aperture in said housing and a second opened position removed from said aperture.

6. The apparatus of claim 5 wherein said closure means includes first and second plates pivotally coupled to said housing and having respective cut-out portions for receiving said metering, screw when said plates are closed to allow for continued operation of said metering screw when said plates are closed for discharging the particulate materials from said transition tube into said output mixing stage.

7. The apparatus of claim 6 further comprising flow reversing means disposed in said hopper for mixing the particulate materials and for displacing the particulate materials away from the aperture in said hopper when the aperture is closed by said first and second plates.

8. The apparatus of claim 7 wherein said flow reversing means includes a first agitator coupled to said metering screw for rotation therewith for mixing the particulate materials and for directing the particulate materials away from the aperture in said housing for preventing build-up of the particulate materials against said first and second plates when said plates are closed.

9. The apparatus of claim 8 further comprising a second agitator coupled to said metering screw for rotation therewith for mixing the particulate materials and for directing the particulate materials toward the aperture in said housing for removal from the housing through the aperture therein by said metering screw.

10. The apparatus of claim 9 wherein said first agitator includes an outer helix member and said second agitator includes an inner helix member, and wherein said outer and inner helix members are concentrically disposed about and aligned with said metering screw.

11. The apparatus of claim 10 wherein said housing includes an inner trough-forming wall extending the length of said housing and disposed in closely spaced relation to said outer helix member.

12. The apparatus of claim 1 further comprising detachable connecting means for removably coupling said transition tube to said housing.

13. The apparatus of claim 1 further comprising drive means for rotationally displacing said first displacement means.

14. The apparatus of claim 13 wherein said drive means includes a gas, hydraulic or electric motor.

15. The apparatus of claim 1 wherein said first displacement means includes a metering screw and wherein said the second displacement means includes an auger screw detachably coupled to said metering screw.

16. The apparatus of claim 15 wherein said auger screw includes an outer continuous helical coil disposed in close proximity to an inner surface of said mixing tube and an inner helical wall coupled to and extending inwardly from said outer helical coil to a position in closely spaced relation from an end of said metering screw.

17. The apparatus of claim 16 further comprising detachable means for removably coupling said auger screw to said metering screw.

18. The apparatus of claim 17 wherein said baffle assembly is removably disposed within said mixing tube and extends along the length thereof for mixing the particulate materials with the liquid.

19. The apparatus of claim 18 wherein said baffle assembly includes an axial rod coupled to a plurality of angled baffle plates arranged in a spaced manner along the length of said rod for alternately deflecting the slurry in first and second opposed directions generally transverse to said axial rod.

20. The apparatus of claim 19 wherein said axial rod and baffle plates are removably inserted in said mixing tube and are disposed within the outer helical coil of said auger screw.

21. A continuous mixing apparatus for granular materials comprising:

a dynamic input mixing stage including a housing with a metering screw for mixing the granular materials and discharging the granular materials through an aperture in said housing;

a static output mixing stage coupled to said housing adjacent said aperture therein for receiving the granular materials and mixing the granular materials with a liquid in forming a slurry;

adjustable closure means disposed adjacent the aperture in said housing for varying or blocking the flow of granular materials from said input mixing stage to said output mixing stage when closed; and flow reversing means disposed in said housing for mixing the granular materials and displacing the granular materials away from said closure means when said closure means blocks the flow of granular materials in preventing dense packing of granular materials against said closure means when said closure means is closed.

22. The apparatus of claim 21 wherein said closure means includes a plurality of plates each movable between a first closed position over the aperture in said housing and a second open position removed from said aperture.

23. The apparatus of claim 22 wherein said closure means includes first and second generally flat plates pivotally coupled to said housing and movable between said first closed and said second open positions.

24. The apparatus of claim 23 wherein each plate includes a respective handle for manually moving said plates between said first closed and said second open positions.

25. The apparatus of claim 24 wherein each plate further includes a respective recessed portion positioned adjacent said metering screw when said plates are in said first closed position to permit continued operation of said metering screw when said plates are closed.

26. The apparatus of claim 22 wherein said flow reversing means includes a first agitator coupled to said metering screw for rotation therewith for mixing the granular materials and directing the granular materials away from the aperture in said housing for preventing build-up of the granular materials against said plates when said plates are closed.

27. The apparatus of claim 26 further comprising a second agitator coupled to said metering screw for rotation therewith for mixing the granular materials and directing the granular materials toward the aperture in said housing for removal from the housing through the aperture therein by said metering screw.

28. The apparatus of claim 27 wherein said first agitator includes an outer helix member and said second agitator includes an inner helix member, and wherein said outer and inner helix members are concentrically disposed about and aligned with said metering screw.

29. The apparatus of claim 28 wherein said housing includes an inner trough-forming wall extending the length of said housing and disposed in closely spaced relation to said outer helix member.

30. The apparatus of claim 29 further comprising detachable connecting means for removably coupling said static output mixing stage to said dynamic input mixing stage.

31. The apparatus of claim 30 further comprising drive means for rotationally displacing said metering screw.

32. The apparatus of claim 31 wherein said drive means includes a gas, hydraulic or electric motor.

33. Apparatus for continuously mixing particulate material with a liquid, said apparatus comprising:

an elongated, linear tube having a longitudinal axis and first and second opposed ends and an intermediate portion disposed therebetween, wherein particulate material is introduced in said tube at the first end thereof;

a source of liquid coupled to the intermediate portion of said tube for adding liquid to the particulate material in forming a particulate-liquid slurry;

displacement means for moving the particulate material from the first end to the intermediate portion of the tube and for moving the slurry from the intermediate portion to the second end of said tube for discharge therefrom; and mixing means fixedly disposed in said tube for deflecting the particulate material and the slurry in alternating first and second opposed directions generally transverse to the longitudinal axis of said tube to provide a homogeneous mixture in the slurry discharged from said tube wherein said mixing means includes a baffle assembly removably disposed within said tube and extending along the length thereof for mixing the particulate material with the liquid.

34. The apparatus of claim 33 wherein said displacement means includes an auger screw coupled to a drive source for rotationally displacing said auger screw.

35. The apparatus of claim 34 wherein said drive source includes a rotating shaft and said auger screw includes an outer continuous helical coil disposed in close proximity to a n inner surface of said tube and an inner helical wall coupled to and extending inwardly from said outer helical coil to a position in closely spaced relation from an end of said rotating shaft.

36. The apparatus of claim 35 further comprising detachable coupling means for removably coupling said auger screw to said rotating shaft.

37. The apparatus of claim 35 wherein said inner helical wall is disposed in the first end of said tube.

38. The apparatus of claim 37 wherein said source of liquid is coupled to said tube at a location intermediate said inner helical wall of said auger screw and the second end of said tube.

39. The apparatus of claim 33 wherein said baffle assembly includes an axial rod coupled to a plurality of angled baffle plates arranged in a spaced manner along the length of said rod for alternately deflecting the particulate-liquid slurry in first and second opposed directions generally transverse to said axial rod.

40. The apparatus of claim 39 wherein said axial rod and baffle plates are removably inserted in said mixing tube and are disposed within the outer helical coil of said auger screw.

* * * * *

UNITED STATES PATENT AND TRADEMARK OFFICE

CERTIFICATE OF CORRECTION

PATENT NO. : 6,123,445

DATED : September 26, 2000

INVENTOR(S) : Frank Grassi

It is certified that error appears in the above-identified patent and that said Letters Patent is hereby corrected as shown below:

| COLUMN | LINE | DESCRIPTION |
|---|---|---|
| 3 | 26 | "wail" should be --wall-- |
| 4 | 48 | "Wall" should be --wall-- |
| 4 | 51 | "wail" should be --wall-- |
| 5 | 22 | "these" should be --These-- |
| 5 | 57 | "45. Such" should be --45, such-- |
| 8 | 06 | "wail" should be --wall-- |
| 9 | 14 | "metering, screw" should be --metering screw-- |
| 12 | 09 | "a n" should be --an-- |

Signed and Sealed this

First Day of May, 2001

*Attest:*

Nicholas P. Godici

NICHOLAS P. GODICI

*Attesting Officer*

*Acting Director of the United States Patent and Trademark Office*